US005885121A

United States Patent [19]

Nanami et al.

[11] Patent Number: 5,885,121

[45] Date of Patent: Mar. 23, 1999

[54] COOLING SYSTEM FOR WATERCRAFT ENGINE

[75] Inventors: Masayoshi Nanami; Toshiyuki Hattori, both of Iwata, Japan

[73] Assignee: Yamaha Hatsudoki Kabushiki Kaisha, Iwata, Japan

[21] Appl. No.: 820,799

[22] Filed: Mar. 19, 1997

[30] Foreign Application Priority Data

Mar. 19, 1996 [JP] Japan ..... 8-063199

[51] Int. Cl.[6] ..... B63H 21/10

[52] U.S. Cl. ..... 440/88; 440/89

[58] Field of Search ..... 440/88, 89; 123/196 R, 123/196 AB, 195 P; 60/320, 321; 184/6.22

[56] References Cited

U.S. PATENT DOCUMENTS

| | | | |
|---|---|---|---|
| 3,493,081 | 2/1970 | Tado | 440/88 |
| 4,452,194 | 6/1984 | Watanabe . | |
| 4,545,332 | 10/1985 | Suzuki et al. . | |
| 4,588,385 | 5/1986 | Suzuki et al. . | |
| 4,991,546 | 2/1991 | Yoshimura . | |
| 5,036,804 | 8/1991 | Shibata . | |
| 5,048,467 | 9/1991 | Kojima . | |
| 5,109,809 | 5/1992 | Fujimoto . | |
| 5,232,387 | 8/1993 | Sumigawa | 440/89 |
| 5,251,577 | 10/1993 | Kojima . | |
| 5,537,958 | 7/1996 | Nishimura et al. . | |
| 5,555,855 | 9/1996 | Takahashi . | |

*Primary Examiner*—Stephen Avila

*Attorney, Agent, or Firm*—Knobbe, Martens, Olson & Bear LLP

[57] ABSTRACT

In accordance with the present invention there is provided a cooling system for a four-cycle engine utilized to power a water propulsion device of a watercraft of the type including a propulsion passage having an inlet in the bottom of the hull and an outlet at the stern of the watercraft. In a first embodiment, coolant is delivered from the propulsion passage to an exhaust manifold cooling jacket, then to at least one passage extending through the engine and then an exhaust pipe cooling jacket. As an additional aspect of the invention, coolant is provided to an oil cooler for cooling lubricating oil used to lubricate the engine. In another embodiment of the present invention, an exhaust cooling system is provided for the four-cycle engine powering the watercraft, separate from the cooling system for the cylinder block and cylinder head of the engine. Coolant is supplied through cooling jackets provided along substantially the length of the exhaust system from the engine to a discharge from the watercraft.

16 Claims, 13 Drawing Sheets

COOLING SYSTEM FOR WATERCRAFT ENGINE

FIELD OF THE INVENTION

The present invention relates to a cooling system for an engine powering a watercraft. More particularly, the present invention is a cooling system for a four-cycle internal combustion engine powering a personal watercraft.

BACKGROUND OF THE INVENTION

Two-cycle engines are used to power watercraft, including smaller watercraft known as "personal" watercraft. These engines have the advantage that they are fairly powerful, and relatively lightweight and compact.

One particular disadvantage to the two-cycle engine is its emission content. Two-cycle engines exhaust large quantities of carbon monoxide (CO) and various hydrocarbons. When measures are taken to reduce the emission content of the two-cycle engine, other generally undesirable consequences result, such as an increase in the weight of the engine, a reduction of its power output or the like.

Four-cycle engines are commonly used as a power plant in other applications, such as automobiles. These engines have the advantage that their emission content is desirably lower and the engines have a high power output.

On the other hand, heat build-up is a concern when utilizing four-cycle engines in enclosed spaces such as an engine compartment of a watercraft. If inadequately cooled, high temperatures in the combustion chambers may decrease engine performance. In addition, heat generated by the engine may be transmitted to surrounding engine components within the engine compartment enclosed within the hull, causing them to be damaged. If the engine becomes too hot, it may also be hard to restart.

An arrangement for adequately cooling a four-cycle engine for use in a personal watercraft application is desired.

SUMMARY OF THE INVENTION

In accordance with the present invention there is provided a cooling system for a four-cycle engine utilized to power a water propulsion device of a watercraft. Preferably, the watercraft is of the type including a propulsion passage having an inlet in the bottom of the hull and an outlet at the stern of the watercraft. A water propulsion device is positioned within the propulsion passage for expelling water out the outlet for propelling the watercraft.

The engine preferably has a cylinder head connected to a cylinder block and defining at least one, and preferably two, combustion chambers. An exhaust passage leads from each combustion chamber to a passage in an exhaust manifold. An exhaust pipe is utilized to route exhaust from the exhaust manifold to a discharge from the watercraft.

In a first embodiment of the present invention, the cooling system includes an exhaust manifold cooling jacket, at least one cooling passage extending through the engine, and an exhaust pipe cooling jacket. Means are provided for routing coolant to the exhaust manifold cooling jacket to the cooling passage in the engine to the exhaust pipe cooling jacket. Preferably, a coolant path is provided through the cylinder head and the cylinder block, and the coolant is routed from the exhaust manifold cooling jacket to the cylinder head, then the cylinder block and then the exhaust pipe cooling jacket.

As an additional aspect of the invention, the engine preferably includes a lubricating system including an oil cooler. A coolant supply is provided to the oil cooler for cooling the oil. In one version, the coolant is supplied separately from the coolant supply supplying coolant to the exhaust manifold cooling jacket. In this version, a coolant outlet is provided from the oil cooler, with a portion of the coolant utilized as a coolant tell-tale and the remainder routed to the exhaust manifold cooling jacket. In another version, coolant is supplied first to the engine and exhaust system and is then routed to the oil cooler.

As yet another aspect of the present invention, an exhaust cooling system is provided for the four-cycle engine powering the watercraft, separate from the cooling system for the cylinder block and cylinder head of the engine. In this arrangement, coolant is supplied through a cooling jacket extending around substantially the length of the exhaust system from the engine to a discharge from the watercraft. In a preferred arrangement, the exhaust system includes a separate exhaust passage leading from each combustion chamber into separate chambers of a first water lock, and then a passage in an upper exhaust pipe leading from each chamber of the water lock to a second water lock, and then a single passage leading through a lower exhaust pipe from the second water lock to a discharge in the propulsion passage. A separate coolant jacket is provided around each exhaust passage, the first water lock, the upper exhaust pipe, second water lock and lower exhaust pipe. Coolant is supplied from a port in the propulsion passage by a pressure pump to the coolant jackets, and is returned to the propulsion passage through an outlet at the discharge of the lower exhaust pipe.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
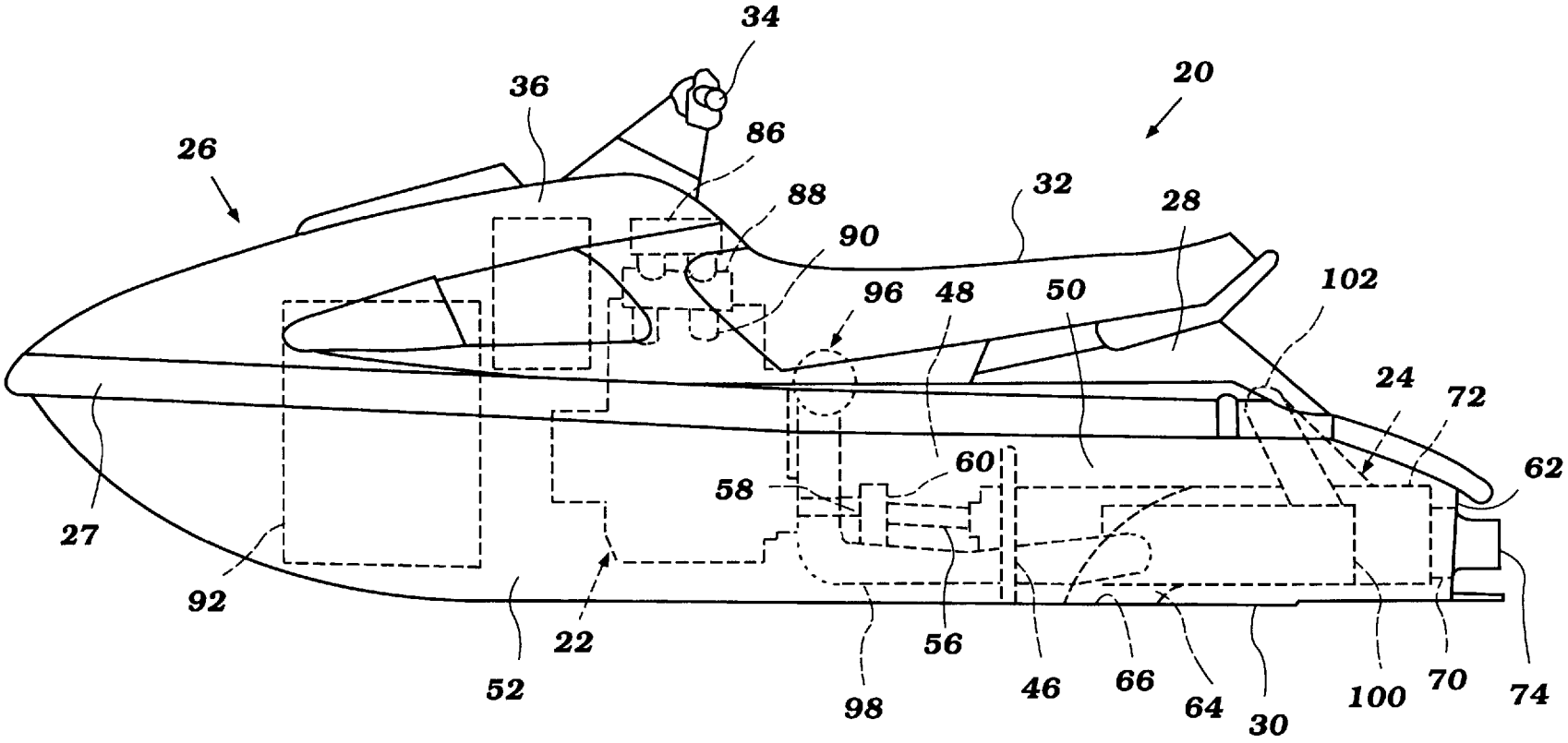
FIG. 1 is a side view, with internal parts illustrated in phantom, of a watercraft powered by an engine including a cooling system in accordance with the present invention.

FIG. 1 illustrates a watercraft 20 having a propulsion unit 24 powered by an engine 22 which is cooled with a cooling system in accordance with the present invention. The watercraft 20 has a hull 26 having a top portion or deck 28 and a lower portion 30. A gunnel 27 defines the intersection of the hull 26 and the deck 28.

A seat 32 is positioned on the top portion 28 of the hull 26. The seat 32 is preferably connected to a removable deck member (not shown) for use in accessing the engine 22. A steering handle 34 is provided adjacent the seat 32 for use by a user in directing the watercraft 20. An access hatch 36 is also preferably provided in the deck 28 in front of the steering handle 34.

Figure 3:
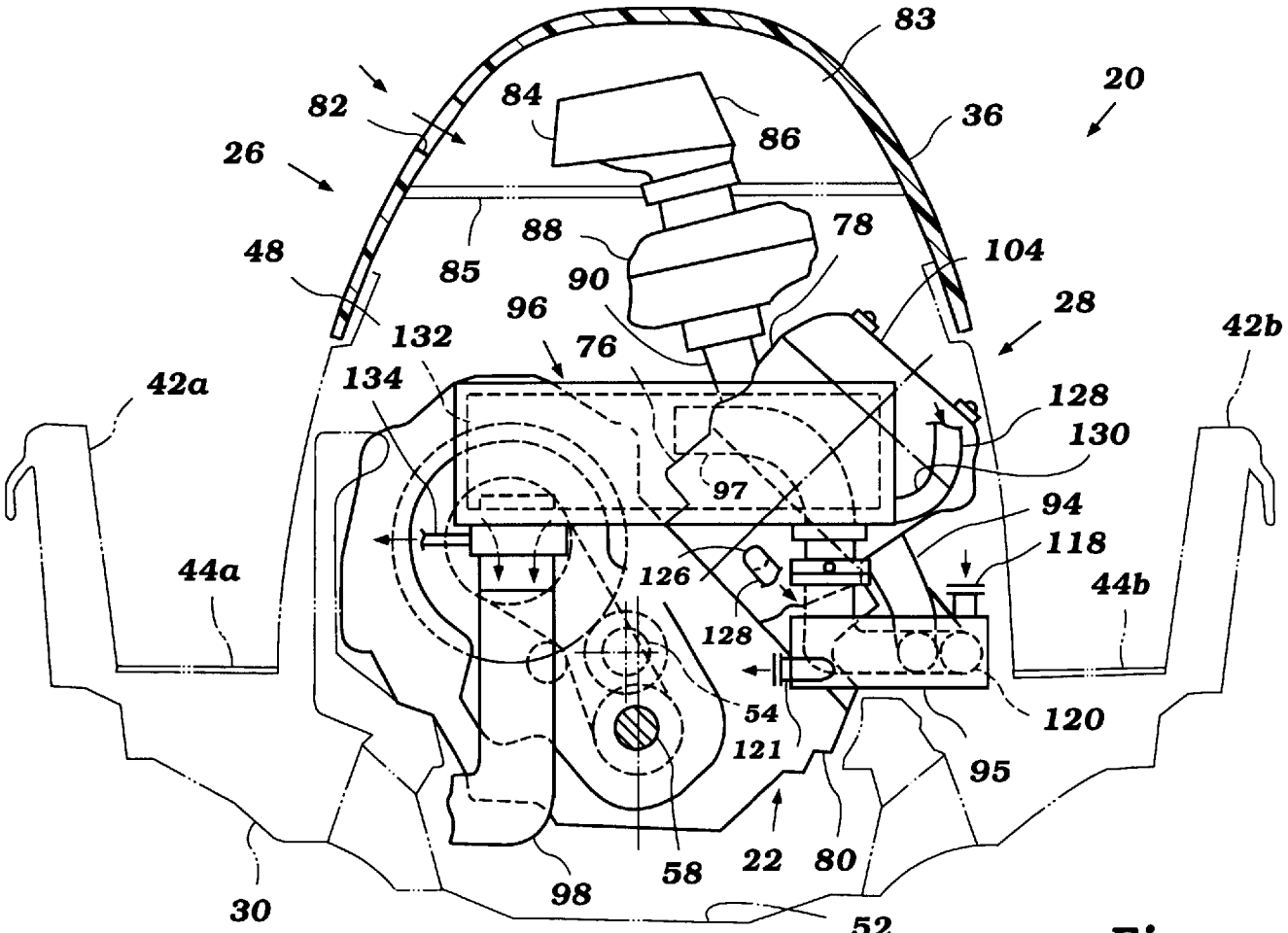
FIG. 3 is a cross-sectional end view of the watercraft illustrated in FIG. 1.

As best illustrated in FIG. 3, a bulwark 42*a,b* extends upwardly along each side of the watercraft 20. A foot step area 44*a,b* is defined between the seat 32 and its adjacent bulwark 42*a,b*.

The top and bottom portions 28,30 of the hull 26, along with a bulkhead 46, define an engine compartment 48 and a pumping chamber 50. The engine 22 is positioned in the engine compartment 48. The engine 22 is preferably connected to the hull 26 via several engine mounts (not shown) connected to a bottom 52 of the lower portion 30 of the hull 26.

Referring also to FIG. 3, the engine 22 has a crankshaft 54 which is in driving relation with an impeller shaft 56 via an output shaft 58. In particular, the crankshaft 54 drives the output shaft 58, which extends outwardly from the rear end of the engine 22. The output shaft 58 is removably coupled to the impeller shaft 56 via a coupling member 60.

The impeller shaft 56 rotationally drives a means for propelling water of the propulsion unit 24, which unit extends out a stern portion 62 of the watercraft 20. The propulsion unit 24 includes a propulsion passage 64 having an intake port 66 which extends through the lower portion 30 of the hull 26. The means for propelling water, preferably an impeller 68 driven by the impeller shaft 56, is positioned, in the passage 64. The passage 64 also has an outlet 70 mounted within a pumping chamber 72 and has its discharge positioned within a nozzle 74. The nozzle 74 is mounted for movement up and down and to the left and right, whereby the direction of the propulsion force for the watercraft 20 may be varied.

Figure 2:
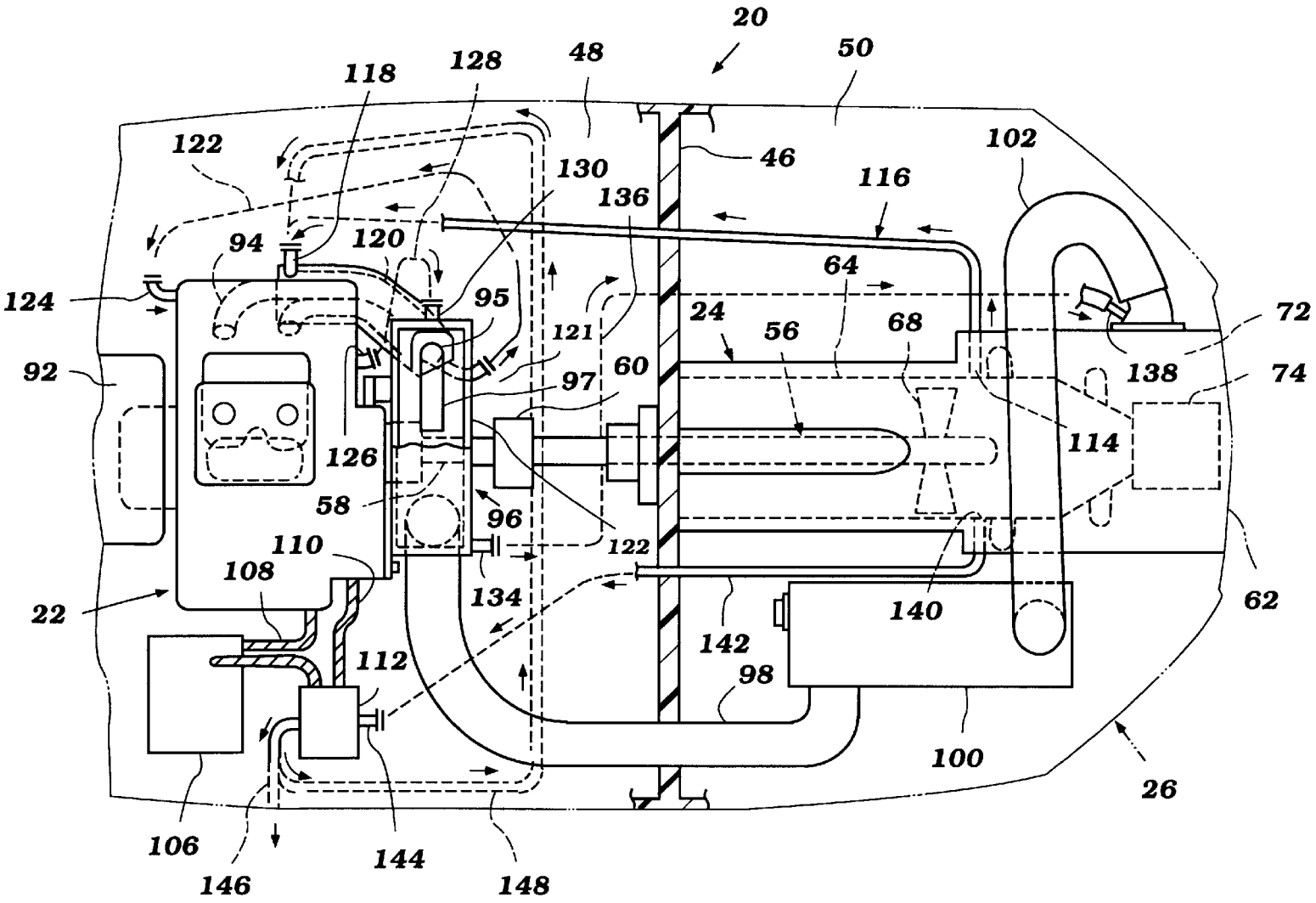
FIG. 2 is a cross-sectional top view of the watercraft of FIG. 1, illustrating a portion of the engine and water propulsion unit in a hull thereof.

The engine 22 is best illustrated in FIGS. 2 and 3. As illustrated therein, the engine 22 is preferably of the two-cylinder, four-cycle variety. Of course, the engine 22 may have as few as one, or more than two, cylinders, as may be appreciated by one skilled in the art.

The engine 22 includes a cylinder block 76 having a cylinder head 78 connected thereto and cooperating therewith to define two combustion chambers (not shown). A piston is movably mounted in each cylinder, and connected to the crankshaft 54 via a connecting rod, as is well known to those skilled in the art.

The crankshaft 54 is rotatably journalled with respect to the cylinder block 76 within a crankcase 80 portion of the engine 22. Preferably, the chamber 80 is defined by a crankcase cover member which extends from a bottom portion of the cylinder block 76.

The engine 22 includes means for providing an air and fuel mixture to each combustion chamber. Preferably, air is drawn into the engine compartment 48 through an air inlet 82 in the hull 26, as illustrated in FIG. 3 into an air chamber 83 formed between the hatch 36 and a divider 85 positioned within the hull 26. Air is then drawn through an intake 84 of air box or silencer 86 which is positioned within the air chamber 83. The air drawn into the silencer 86 passes into an air intake passage leading through an intake manifold 90 corresponding to each combustion chamber (i.e., in this case, there are two of such passages). Preferably, the flow of air into each combustion chamber is regulated by at least one camshaft operated intake valve (not shown), as is well known to those skilled in the art.

Preferably, fuel is provided to each combustion chamber by a carburetor 88 positioned along each intake passage (i.e. there are two carburetors 88 in this embodiment) between the silencer 86 and the intake manifold 90. The carburetor 88 is preferably linked to an operator control at the steering handle 34 for use by the operator in controlling the speed of the engine 22. Fuel is supplied by a fuel pump (not shown) from a fuel tank 92 positioned in the engine compartment 48. Of course, as one skilled in the art may appreciate, fuel may be supplied to the engine 22 with direct or indirect fuel injection instead of via carburation.

A suitable ignition system is provided for igniting the air and fuel mixture provided to each combustion chamber. Preferably, this system comprises a spark plug (not shown) corresponding to each combustion chamber. The spark plugs are preferably fired by a suitable ignition system, which preferably includes an electronic control.

Exhaust gas generated by the engine 22 is routed from the engine to a point external to the watercraft 20 by an exhaust system. In particular, exhaust from each combustion chamber is preferably expelled from the combustion chamber to passages extending through an exhaust manifold 94 through one or more exhaust passages in the cylinder head 78 (not shown). Means are provided for controlling the flow of exhaust gases through these exhaust passages. Preferably, this means comprises an exhaust valve. Each exhaust valve is actuated by a common exhaust camshaft.

As best illustrated in FIGS. 2 and 3, exhaust passing into the passages in the upper exhaust manifold 94 is routed into a merge pipe 95, where the exhaust gas flowing through each passage in the exhaust manifold 94 are combined. The combined exhaust then flows out an end 97 of the merge pipe 95 into an exhaust chamber 96 formed at an upper end of an exhaust pipe 98, which serves primarily as an exhaust silencer. The exhaust is then routed from the chamber 96 through the remainder of the upper exhaust pipe 98, through a water lock 100, and then through a lower exhaust pipe 102. The lower exhaust pipe 102 discharges into the pumping chamber 72 near the stern 62 of the watercraft 20 for discharge therefrom.

The intake and exhaust camshafts are mounted for rotation with respect to the cylinder head 78. The camshafts are positioned within a camshaft chamber formed by a camshaft cover 104 connected to the cylinder head 78. Means are provided for rotating the camshafts to effectuate movement of the intake and exhaust valves. Preferably, this means comprises a timing belt (not shown) which extends about a camshaft sprocket positioned on an end of each camshaft and a drive pulley mounted on the crankshaft 54.

The engine 22 includes a lubricating system for providing lubricating oil to the various moving parts thereof. An oil tank or reservoir 106 is provided separate from the engine. An oil supply line or hose 108 extends from the reservoir 106 to a supply port extending into the cylinder block 76. An oil pump (not shown) is provided for pumping the oil through an oil filter and then through the oil gallery of the engine 22. The oil is returned from the engine 22 through a return line 110 which leads to an oil cooler 112. The oil cooler is a heat-exchanger with a liquid cooling system disclosed below, for cooling the lubricating oil. The cooled oil is returned to the reservoir 106 after being cooled in the oil cooler 112.

Figure 4:
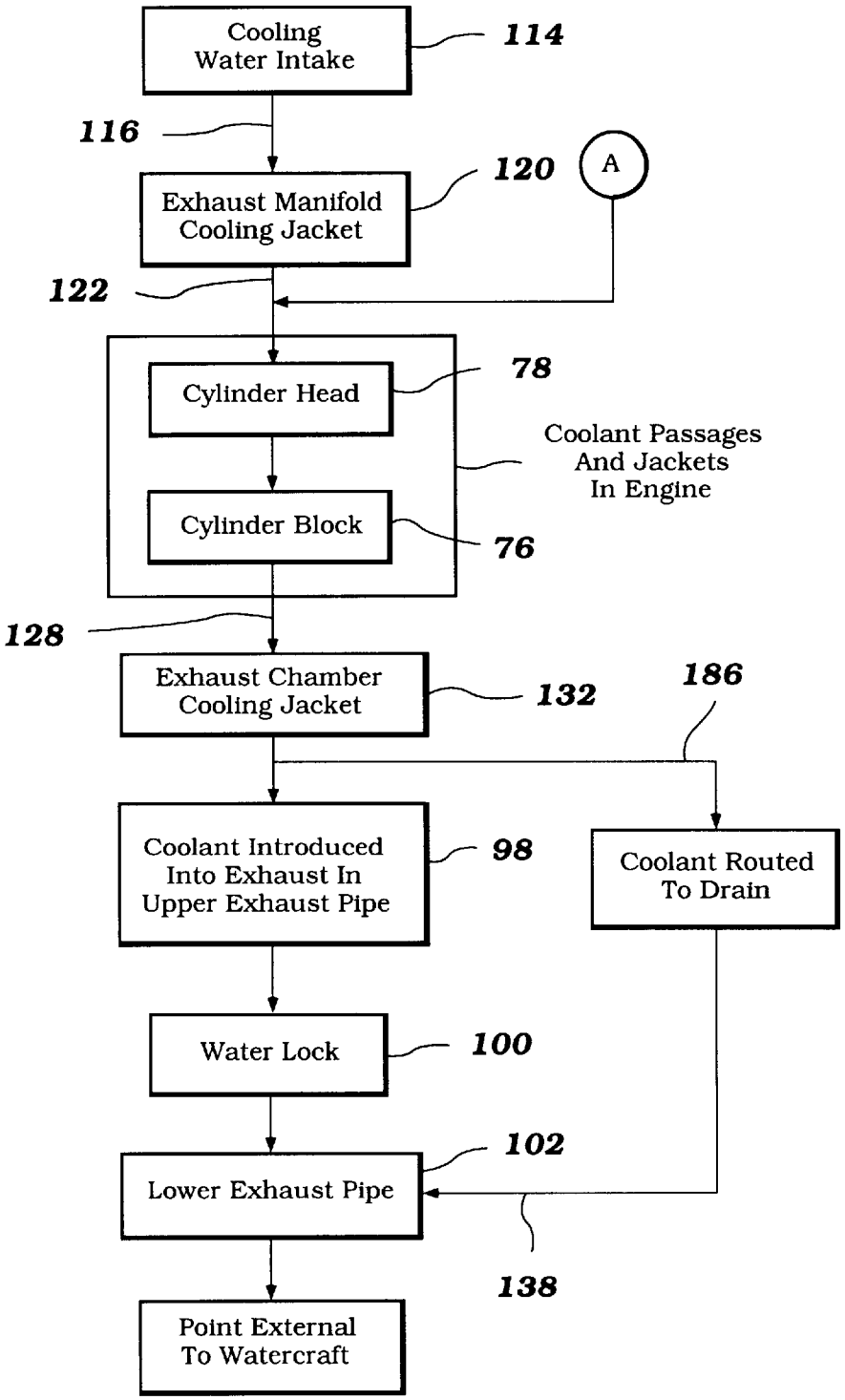
FIG. 4 is a flowchart detailing a primary coolant flow path through the watercraft illustrated in FIG. 1.
Figure 5:
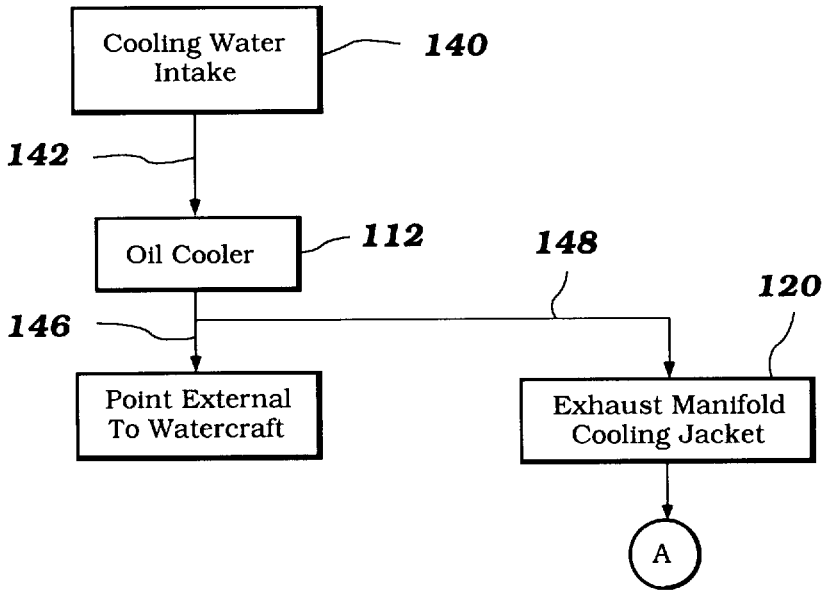
FIG. 5 is a flowchart detailing a secondary coolant flow path through the watercraft illustrated in FIG. 1.

In accordance with the present invention, the engine 22 includes a liquid cooling system. A primary cooling system (illustrated schematically in FIG. 4) for cooling the engine 22 and exhaust system. In addition, a secondary cooling system (illustrated schematically in FIG. 5) is provided primarily for cooling the lubricating oil.

The primary cooling system will be described in conjunction with FIGS. 2–5. As illustrated therein, cooling water is drawn through an intake 114 from the high pressure area within the propulsion passage 64. Coolant passes from the intake 114 through a main supply pipe 116 to a cooling water inlet port 118 of an exhaust manifold cooling jacket 120. This cooling jacket 120 surrounds at least a portion of the exhaust manifold 94 for cooling the exhaust gases flowing therethrough.

Coolant in the jacket 120 exits through a drain 121 into a first coolant hose 122 which leads to a cylinder head coolant inlet 124. The coolant is circulated through one or more coolant passages within the cylinder head 78 for cooling the exhaust gases passing through the exhaust passages therein and the portion of the combustion chambers formed therein. The coolant is then routed, preferably internally, to one or more coolant passages in the cylinder block 76.

After passing through the cylinder block 76, the coolant flows through a cylinder block coolant drain 126 to a second coolant hose 128 leading to an inlet 130 of an exhaust chamber coolant jacket 132. The exhaust chamber coolant jacket 132 surrounds at least a portion of the exhaust chamber 96 for cooling the exhaust gases therein.

Preferably a portion of the coolant passes through an outlet extending in communication with the jacket 132 of the exhaust chamber 96 into the exhaust gases as they flow therefrom into the remainder of the upper exhaust pipe 98. The remainder of the coolant exits the jacket 132 through a drain 134 leading to a third hose or return line 136 leading to a discharge 138. Preferably, the discharge 138 is positioned within the lower exhaust pipe 102.

A secondary cooling system is also provided. This cooling system, which is illustrated schematically in FIG. 5, has a coolant inlet 140 also positioned within the propulsion passage 64 and downstream of the impeller 68. The inlet leads to a supply line or pipe 142 which extends to a water inlet 144 of the oil cooler 112. The coolant is supplied through the inlet 144 into water passages and jackets within the cooler 112 for cooling the oil passing therethrough. A drain pipe 146 leads from the cooler 112 to a pilot port in the hull 26 of the watercraft 20 for providing a cooling water tell-tale. The remainder of the coolant is supplied through a hose 148 to the inlet 118 of the exhaust manifold cooling jacket 120.

As an alternate arrangement to the primary and secondary cooling systems described above, it is contemplated that the primary coolant source for the oil cooler 112 may be the coolant return after the coolant has passed through the cylinder head 78, block 76 and around the exhaust chamber 96, instead of a separate supply line from the propulsion passage 64. In this arrangement, the coolant which is normally returned to the pumping chamber 72 through the return line 136 may be instead supplied to the inlet line 142 of the oil cooler 112.

Also, it is possible to supply coolant to the passages or jackets within the cylinder head 78 and block 76 in parallel from the jacket 120 surrounding the exhaust manifold 94, instead of in succession from the cylinder head 78 to the cylinder block 76.

Figure 6:
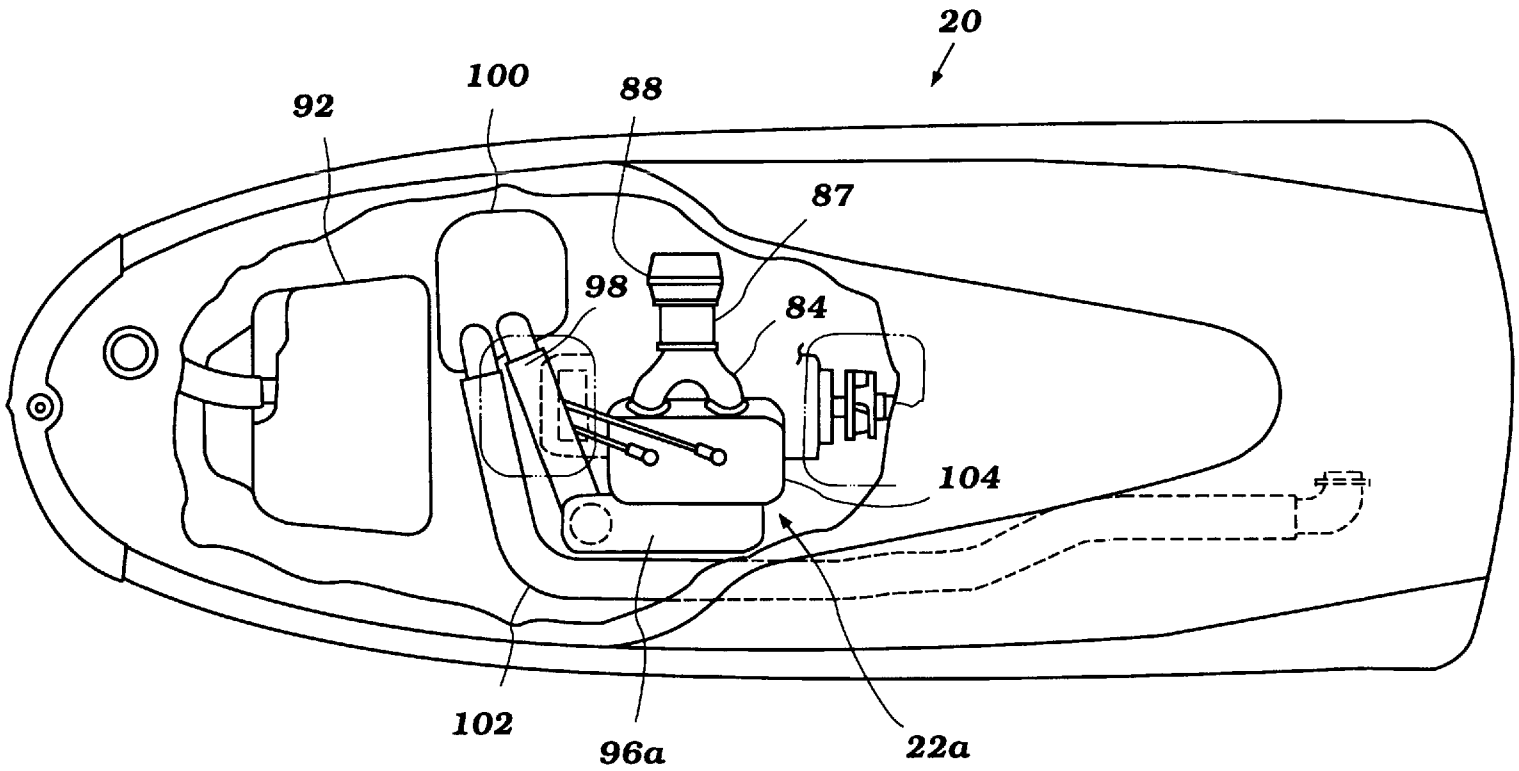
FIG. 6 is a top view of a watercraft similar to that illustrated in FIG. 1, with portions cut-away, illustrating an engine and cooling arrangement in accordance with a first alternate embodiment of the present invention.
Figure 7:
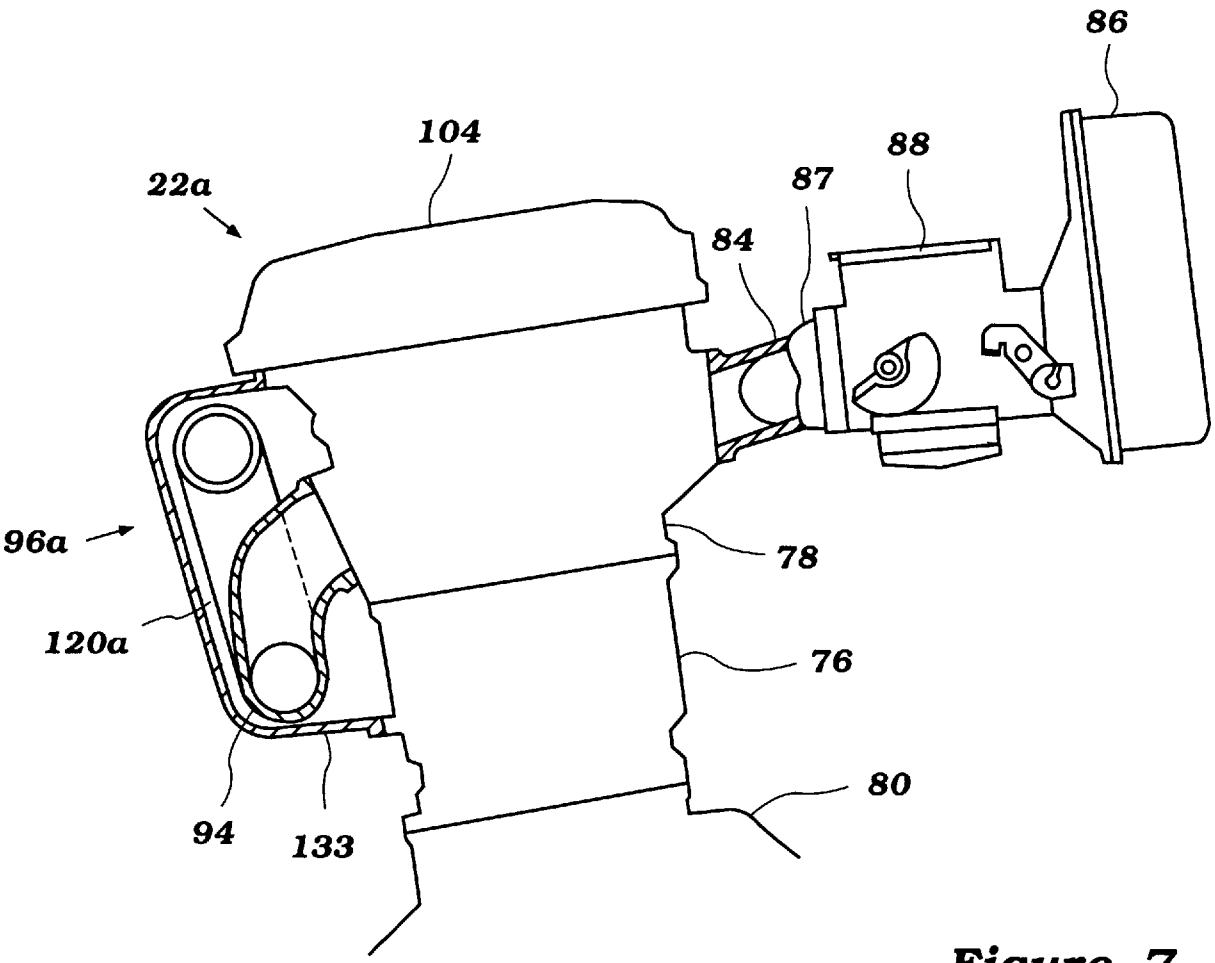
FIG. 7 is an enlarged side view of a cylinder head and intake and exhaust system connected thereto, of the engine illustrated in FIG. 6.

FIGS. 6 and 7 illustrate a watercraft 20 having an alternate embodiment engine 22*a* and cooling system in accordance with the present invention In these figures, like parts have been given like numerals with those of the embodiment described above and illustrated in FIGS. 1–5.

In this arrangement, the engine 22*a* has a single carburetor 88 for providing fuel to the two combustion chambers of the engine. In particular, the carburetor 88 has an air inlet in direct communication with the air outlet of the silencer 86. Fuel is added to the air passing through the carburetor 88 in a manner known to those skilled in the art.

The air and fuel mixture passes from the carburetor 88 into an outlet pipe 87 which leads to a branching intake manifold 84. The intake manifold 84 has a single passage in communication with the outlet pipe 87, but branches into a pair of passages corresponding to the intake passage of each combustion chamber extending through the cylinder head 78.

Preferably, the exhaust from each combustion chamber is routed through an exhaust passage leading through the cylinder head 78 to a passage in an exhaust manifold 94. Preferably, the exhaust manifold 94 is positioned within an exhaust chamber 96a formed by a cover 133 engaging a side of the cylinder block 76 and head 78. Exhaust passes through the exhaust manifold 94 in the chamber 96*a* to the upper exhaust pipe 98, then through a water lock 100 (preferably positioned in front of the engine 22*a*) through the lower exhaust pipe 102 to discharge, similar to the arrangement described above.

In this arrangement, the cooling system preferably takes a path similar to that described above, except that the merge pipe 95 is, in essence eliminated since the manifold 94 terminates within a chamber 96*a* formed by the cover 133. In this arrangement, the cooling water preferably passes through a coolant jacket 120*a* comprising the interior of the chamber 96*a*. In this manner, the jacket 120*a* serves to both cool and silence the exhaust system. The cooling water may pass through this jacket 120*a* and then through the engine 22*a*, or through the engine 22*a*and then the jacket 120*a*.

The arrangement of the water lock 100 at the front of the engine 22*a*, along with a single carburetor 88 extending outward from the engine generally perpendicular to the axis of the crankshaft provides an open space near the rear end of the engine which provides access to the carburetor 88 and other engine features for maintenance.

Figure 8:
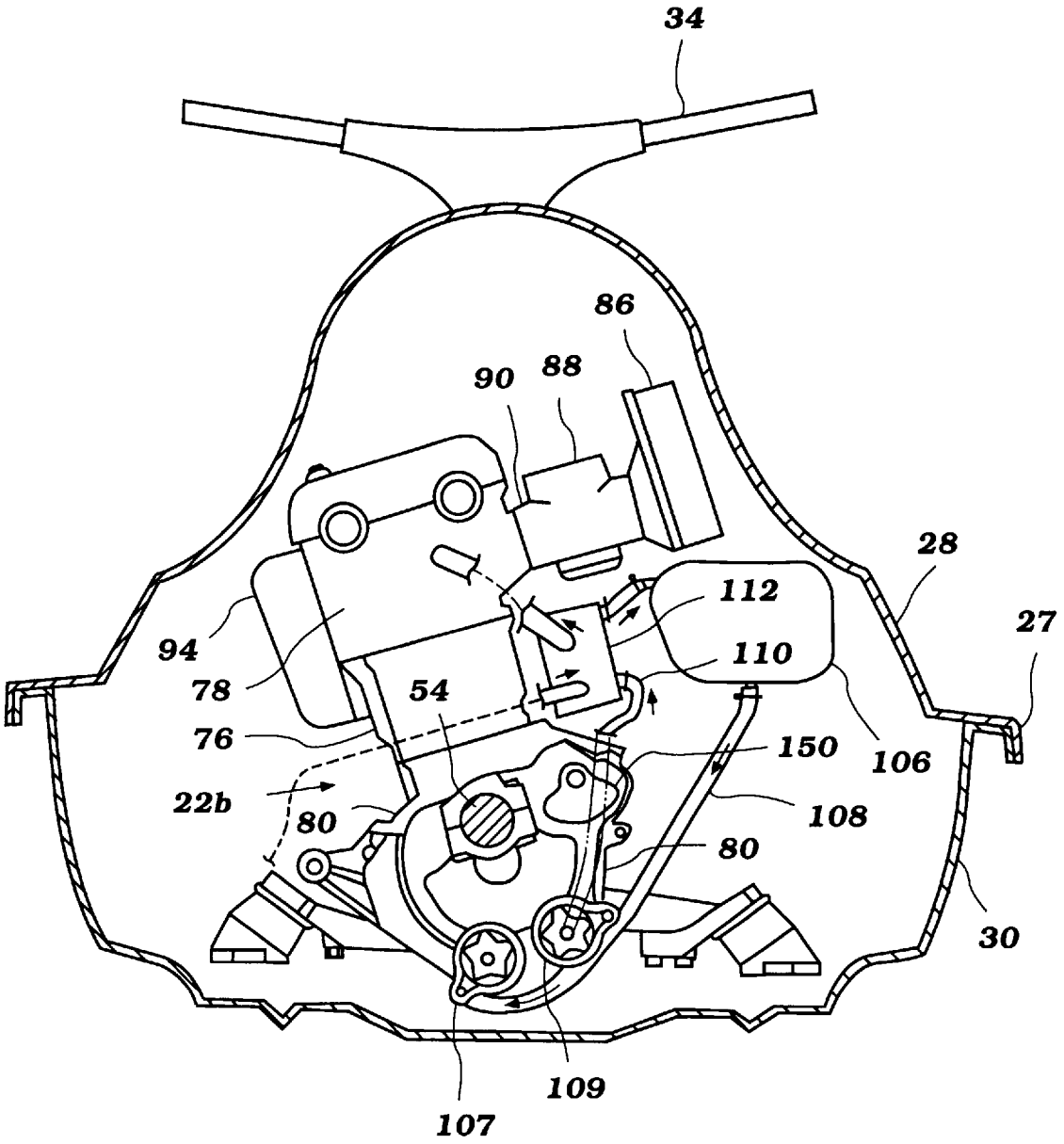
FIG. 8 is a cross-sectional end view of a watercraft similar to that illustrated in FIG. 1 and having an engine and cooling arrangement in accordance with a second alternate embodiment of the present invention.

FIG. 8 illustrates a second alternate embodiment engine 22*b* and cooling system in accordance with the present invention. Like reference numbers have been utilized for like parts with reference made to the engine embodiment described above and illustrated in FIGS. 1–5.

As illustrated therein, the intake manifold 90, carburetor 88 and intake silencer 86 all preferably extend outwardly of the cylinder head 78 generally perpendicular thereto. Preferably, the oil cooler 112 is positioned in the otherwise empty space within the engine compartment below the intake system and above the crankcase 80. Oil is supplied to the lubricating system of the engine 22*b* from an oil reservoir 106 also positioned generally below the intake system. This arrangement is beneficial since it distributes the engine weight more evenly across the width of the watercraft 20.

Oil is drawn from the oil reservoir 106 by a pressure pump 107 through a supply line 108. This oil is pumped throughout the engine 22*b*. The oil drains into an oil collector, from which it is drawn by a return pump 109. The return pump 109 delivers the oil through a line 110 to the oil cooler 112.

Oil passing through the oil cooler 112 is cooled by coolant passing through a water jacket corresponding thereto. Coolant is preferably delivered to the oil cooler 112 through a cooling system in a manner similar to that described above.

Preferably, the cooling system overall takes a path similar to that described above, except that as with the embodiment illustrated in FIGS. 6 and 7, the merge pipe is, in essence, eliminated since the manifold 94 terminates within a chamber formed by a cover.

In addition, the engine 22*b* preferably includes a balancing shaft 150 in the otherwise empty portion of the crankcase chamber 80 near the top thereof in the direction opposite that in which the engine is tilted. The balancing shaft 150 is preferably driven by the crankshaft 54 and serves to balance the engine, reducing engine vibration.

Figure 9:
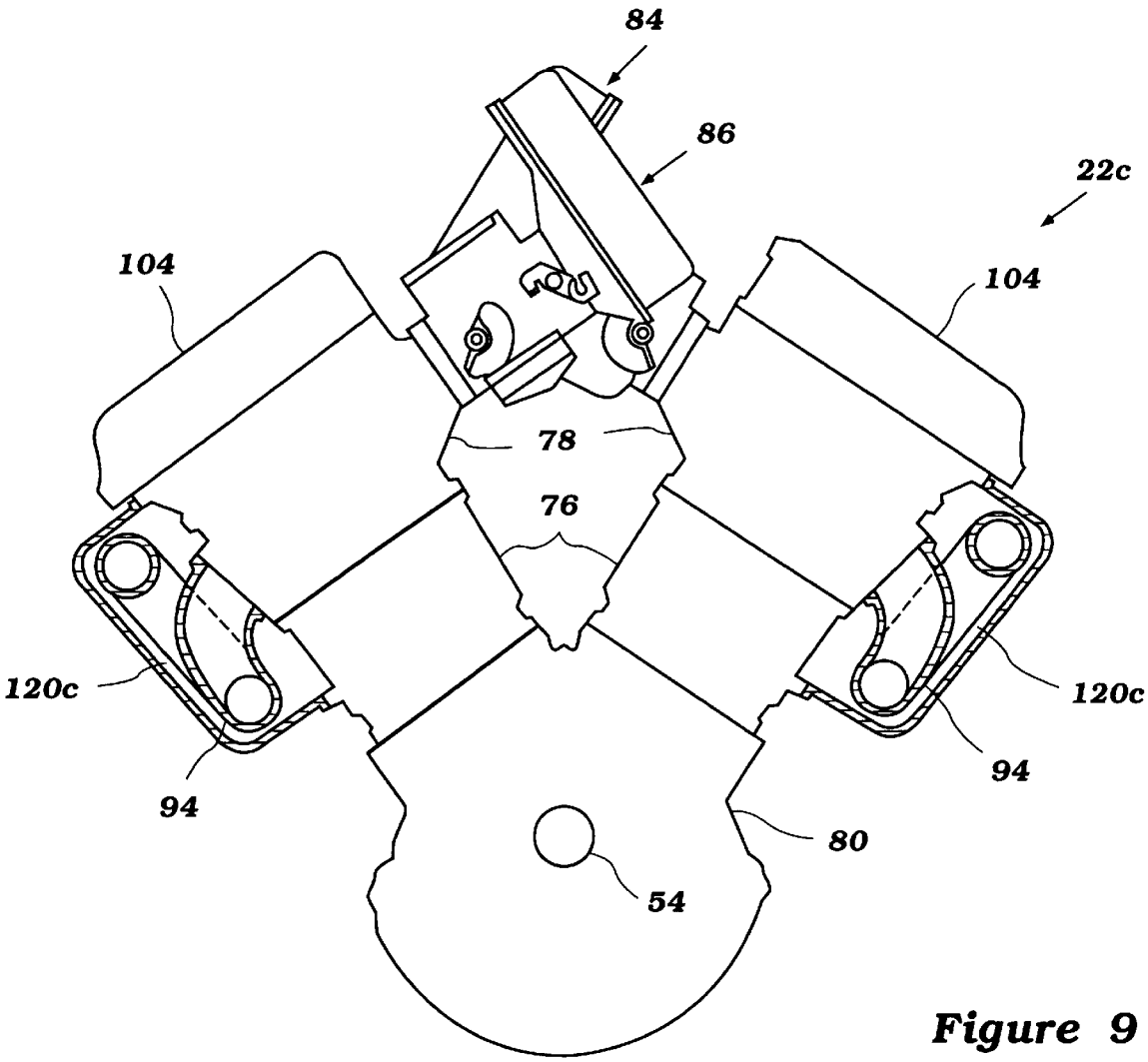
FIG. 9 is an end view of an engine and cooling arrangement in accordance with a third alternate embodiment of the present invention, with portions thereof illustrated in cross-section.

Yet another embodiment engine 22*c* and cooling arrangement is illustrated in FIG. 9. As illustrated therein, the engine 22*c* for powering the watercraft 20 may comprises a four-cycle "V"-type engine 22*c*. In this arrangement, two cylinder heads 78 are provided, one each connected to opposite banks formed by the cylinder block 76 for forming at least one combustion chamber therein.

In this arrangement, the carburetor and intake for each bank of combustion chambers preferably overlaps, such that the total engine width is reduced. This allows the width of the watercraft 20 to be reduced, increasing its maneuverability.

Preferably, an exhaust manifold 94 is provided corresponding to each bank. Preferably, a coolant system having a coolant flow path similar to that described in conjunction with FIGS. 1–5 is utilized, except that as with the embodiment illustrated in FIGS. 6–7, a water jacket 120*c* is provided about the manifold 94 for cooling it.

Figure 10:
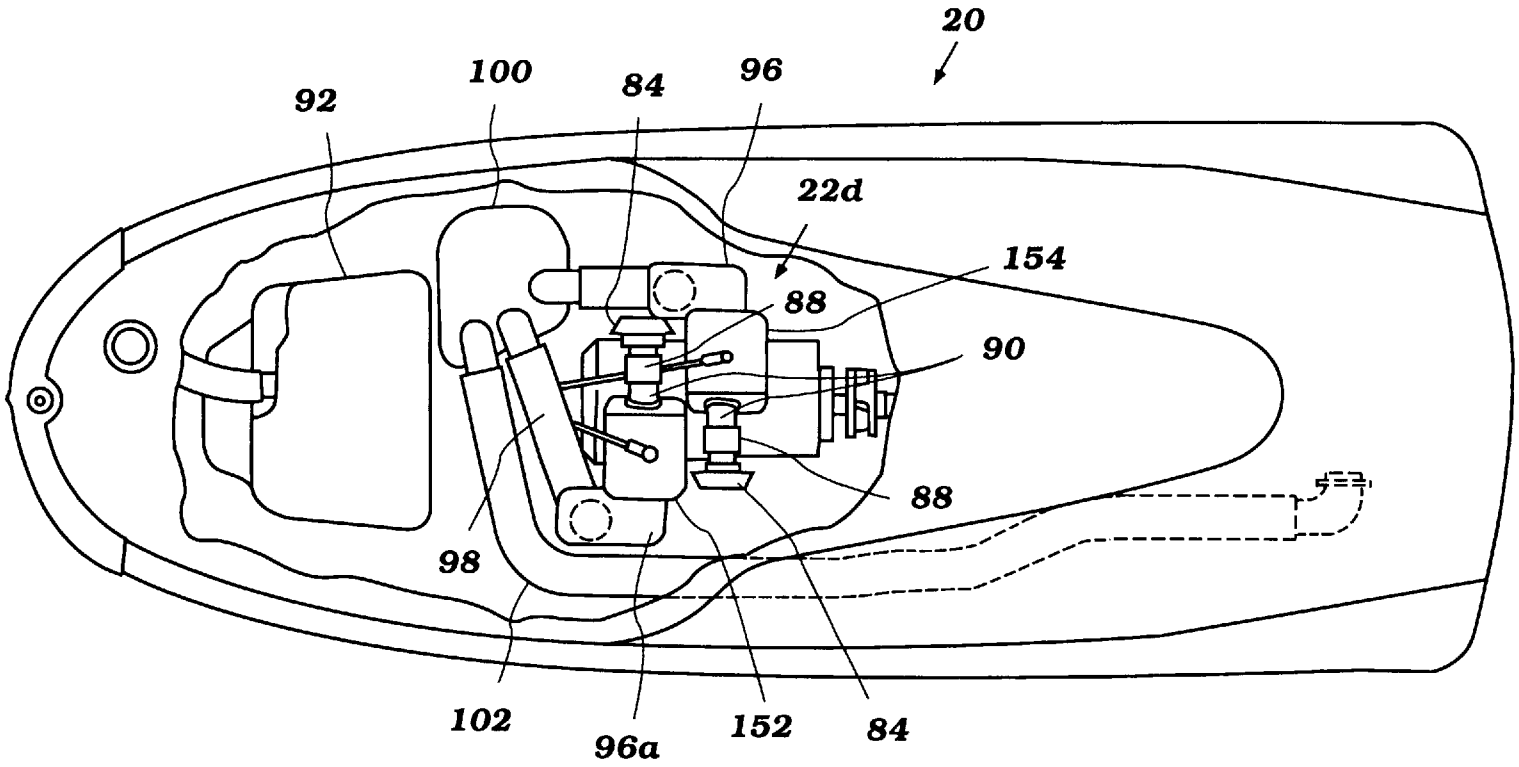
FIG. 10 is a top view of a watercraft similar to that illustrated in FIG. 1, with portions thereof cut-away to illustrate an engine and cooling arrangement in accordance with a fourth alternate embodiment of the present invention.

FIG. 10 illustrates a fourth alternate embodiment engine 22*d* and cooling arrangement in accordance with the present invention. Once again, like numerals have been utilized to designate like parts to those described and illustrated above.

This engine 22*d* is similar to that illustrated and described in conjunction with FIG. 9, being of the "V" type. In this embodiment, however, the separate induction systems for the combustion chamber(s) of each bank 152,154 are positioned opposite one another.

As best illustrated, an air intake 84 leads to a carburetor 88, and on to an intake manifold 90 corresponding to each bank. The induction systems are offset and face in opposing directions. In this manner, the cylinder banks need not be tilted towards the horizontal to the degree illustrated in FIG. 9, as the induction system remains close to the engine 22*d*, keeping its overall profile low and the engine narrow.

Preferably, the engine 22*d* includes a cooling system similar to that described above.

Figure 11:
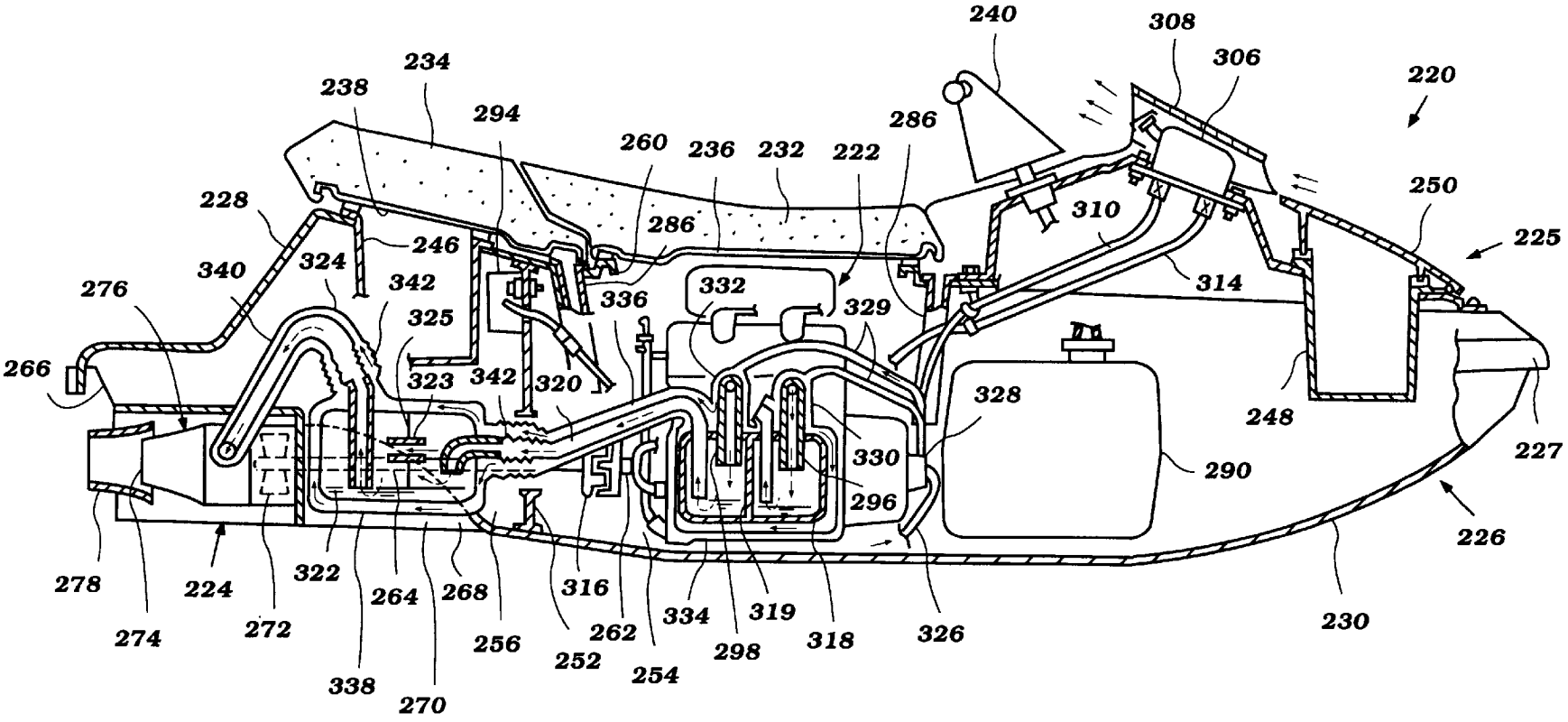
FIG. 11 is a cross-sectional side view of an alternate watercraft powered by an engine and including a cooling arrangement in accordance with a sixth alternate embodiment of the present invention.
Figure 12:
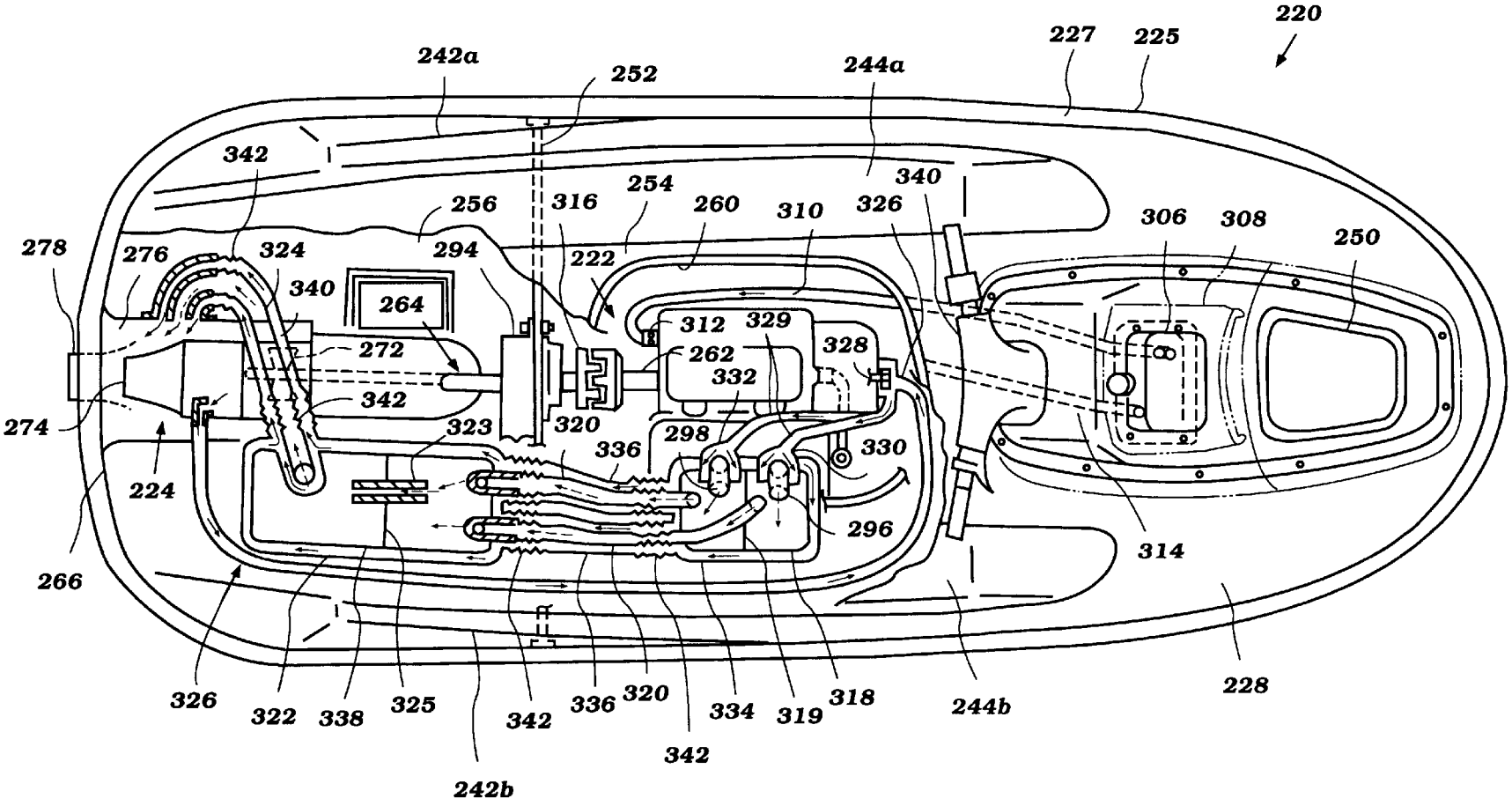
FIG. 12 top view of the watercraft illustrated in FIG. 11, with portions thereof cut-away to illustrate the engine.
Figure 13:
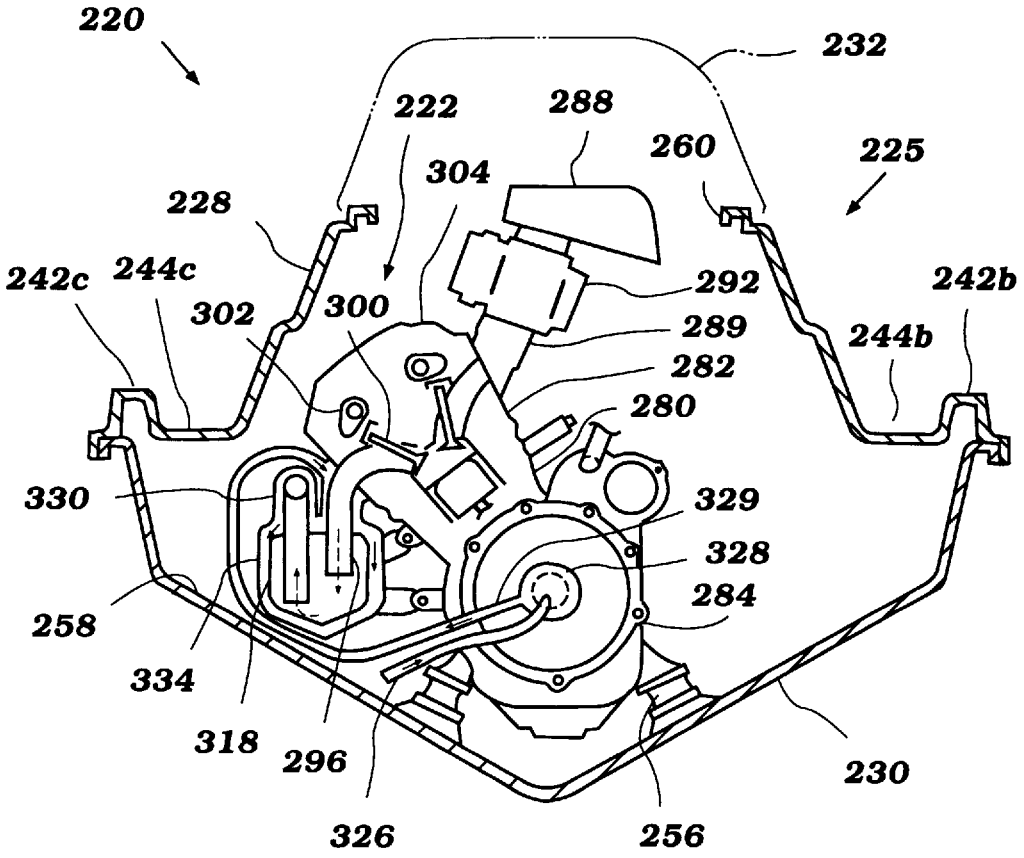
FIG. 13 is a cross-sectional end view of the watercraft illustrated in FIG. 11.

FIGS. 11–13 illustrate another watercraft 220 having an engine 222 cooled with a cooling system in accordance with a fifth alternate arrangement of the present invention. As illustrated, the watercraft 220 is similar to the watercraft 20 described above, and includes a watercraft body 225 comprising a hull 226 having a top portion or deck 228 and a lower portion 230. A gunnel 227 defines the intersection of the hull 226 and the deck 228.

A front seat 232 and a rear seat 234 are positioned on the top portion 228 of the hull 226. The front seat 232 is preferably connected to a first removable deck member 236. The rear seat 234 is preferably connected to a second removable deck member 238. A steering handle 240 is provided adjacent the front seat 232 for use by a user in directing the watercraft 220.

A bulwark 242*a,b* extends upwardly along each side of the watercraft 220. A foot step area 244*a,b* is defined between each seat 232,234 and its adjacent bulwark 242*a,b*.

The watercraft 220 as illustrated in FIG. 11 includes a pair of storage boxes 246,248. A rear storage box 246 is preferably positioned underneath the rear seat 234 and is accessible by removing the second removable deck member 238. The front storage box 248 is preferably a recessed area in the top or lid portion 228 of the hull 226 at the bow of the craft, and includes a cover 250 selectively extendible over the storage box 248 for protecting the items therein from water and the like.

The top and bottom portions 228,230 of the hull 226, along with a bulkhead 252, define an engine compartment 254 and a pumping chamber 256. The engine 222 is positioned in the engine compartment 254. As best illustrated in FIG. 13, the engine 222 is connected to the hull 226 via several engine mounts 256 connected to a bottom 258 of the lower portion 230 of the hull 226. The engine 222 is preferably partially accessible through a maintenance opening 260 accessible by removing the first removable deck member 236 on which the front seat 232 is mounted.

The engine 222 has a crankshaft 262 which is in driving relation with an impeller shaft 264. The impeller shaft 264 rotationally drives a means for propelling water of the propulsion unit 224, which unit extends out a stem portion 266 of the watercraft 220.

The propulsion unit 224 includes a propulsion passage 270 having an intake port 268 which extends through the lower portion 230 of the hull 228. The means for propelling water, preferably an impeller 272 driven by the impeller shaft 264, is positioned in the passage 270. The passage 270 also has an outlet 274 is mounted within a chamber 276 and has its discharge positioned within a nozzle 278. The nozzle 278 is mounted for movement up and down and to the left and right, whereby the direction of the propulsion force for the watercraft 220 may be varied.

The engine 222 is best illustrated in FIG. 11. As illustrated therein, the engine 222 is preferably of the two-cylinder, four-cycle variety. Of course, the engine 222 may have as few as one, or more than two, cylinders, as may be appreciated by one skilled in the art.

The engine 222 includes a cylinder block 280 having a cylinder head 282 connected thereto and cooperating therewith to define two combustion chambers (not shown). A piston is movably mounted in each cylinder, and connected to the crankshaft 262 via a connecting rod, as is well known in the art.

The crankshaft 262 is rotatably journalled with respect to the cylinder block 280 within a crankcase chamber 284. Preferably, the chamber 284 is defined by a crankcase cover member which extends from a bottom portion of the cylinder block 280.

The engine 222 includes means for providing an air and fuel mixture to each combustion chamber. Preferably, air is drawn into the engine compartment 254 through a pair of air inlets 286 in the hull 226, as illustrated in FIG. 11. Air is then drawn into an air intake 288 to an air intake passage extending through a manifold 289. The passages in the manifold 289 lead to corresponding passages extending through the cylinder head 282 to each combustion chamber. Preferably, the flow of air into each combustion chamber is regulated by at least one intake valve (not shown), such as a throttle plate within a carburetor, as described below. The intake valves are operated by an intake camshaft (not shown).

Preferably, fuel is provided to each combustion chamber with the incoming air. In particular, fuel is drawn from a fuel tank 290 positioned in the engine compartment 254, by a fuel pump (not shown), and delivered to a carburetor 292 positioned along each intake passage. A throttle control (not shown) is preferably provided for allowing the watercraft operator to control the rate of fuel and air delivery to the engine 222 for controlling the speed and power output of the engine. It is contemplated that the fuel may be provided by indirect or direct fuel injection, as well as via carburation, as known in the art.

A suitable ignition system is provided for igniting the air and fuel mixture provided to each combustion chamber. Preferably, this system comprises a spark plug (not shown) corresponding to each combustion chamber. The spark plugs are preferably fired by a suitable ignition system, which preferably includes an electronic control 294 connected to the engine 222 by one or more electrical cables. Preferably, the pulser-coil generates firing signals for the ignition system. In addition, the ignition system may include a battery for use in providing power to an electric starter and the like.

Exhaust gas generated by the engine 222 is routed from the engine to a point external to the watercraft 220 by an exhaust system which includes an exhaust manifold 296,298 corresponding to each combustion chamber. In particular, exhaust gases generated by each combustion chamber are routed through an exhaust passage through the cylinder head 282 therefrom to the respective exhaust manifold 296,298. Means are provided for controlling the flow of exhaust gases through the exhaust passages from the combustion chambers. Preferably, this means comprises an exhaust valve 300. Each exhaust valve 300 is actuated by a common exhaust camshaft 302, as is well known to those skilled in the art. The remainder of the exhaust system is disclosed in detail below.

The intake and exhaust camshafts are mounted for rotation with respect to the cylinder head 282. The camshafts are positioned within a camshaft chamber formed by a camshaft cover 304 connected to the cylinder head 282.

Means are provided for rotating the camshafts to effectuate movement of the intake and exhaust valves. Preferably, this means comprises a timing belt (not shown) which extends about a camshaft sprocket positioned on an end of each camshaft and a drive pulley mounted on the crankshaft 262. Other means for driving the camshafts are contemplated, as are well known to those skilled in the art.

The engine 222 includes a lubricating system for providing lubricating oil to the various moving parts thereof. An oil tank or reservoir 306 is provided separate from the engine. The reservoir 306 is preferably connected to the outside of a hatch portion of the hull 226. The reservoir 306 has a fill spout and is preferably obscured under a visor 308 positioned just in front of the steering handle 240. As illustrated in FIG. 11, the oil reservoir 306 is positioned so that air passing along the top surface of the hull 226 passes under the visor 308 and around the reservoir, thereby cooling the oil therein.

An oil supply line 310 or hose extends from the reservoir 306 to a supply port 312 extending into the cylinder block 280. An oil pressure pump is provided for pumping the oil through an oil filter, and then through the oil gallery of the engine 222. The oil drains into an oil collector, from which it is drawn, preferably by a scavenge pump, for return through a return line 314 back to the oil reservoir 232.

As stated above, the crankshaft 262 drives the impeller 272 of the propulsion unit 224. In particular, the end of the crankshaft 262 extends through the crankcase cover to a coupling 316, where it is coupled to an end of the impeller shaft 264.

As best illustrated in FIG. 11, the end of each exhaust manifold 296,298 extends into respective first and second chambers of a first water lock 318, as divided by a wall 319. Exhaust in each chamber of the water lock 318 passes into one of two passages through an upper exhaust pipe 320. This exhaust pipe 320 leads to a second water lock 322. The exhaust passing through each passage in the upper exhaust pipe 320 is exhausted into a first chamber of the second water lock 322, and then passes through a single pipe 323 extending through a wall 325, into a second chamber. From the second chamber, the exhaust passes into a lower exhaust pipe 324. The lower exhaust pipe 324 terminates in the chamber 276, where the exhaust gases from the engine 222 are discharged.

Preferably, expandable bellows-type connectors 342 are provided at the junctions of the coolant jackets or passages, such as at the junction of coolant jackets 338 and 240.

In accordance with the present invention, a cooling system is provided for cooling the engine 222. Cooling water is drawn from the propulsion passage 270, preferably downstream of the impeller 272 through a supply line 326. While the water pressure within the passage 270 may be sufficient to supply the cooling water through the cooling flow path, a pressurizing pump 328 is preferably provided for pressurizing the coolant system. The pump 328 may be of the impeller-type, and driven by the crankshaft 262. The pump 328 is preferably located at the front end of the engine 222. The cooling water is first supplied through first and second lines 329 into respective cooling jackets 330,332 surrounding the exhaust manifolds 296,298. The cooling water then passes from the jackets 330,332 to a cooling jacket 334 corresponding to the first water lock 318.

The cooling water passing through the cooling jacket 334 is routed through a cooling jacket 336 surrounding the upper exhaust pipe 320, and on to a cooling jacket 338 of the second water lock 322. Then the cooling water is routed to a cooling jacket 340 surrounding the lower exhaust pipe 324 and discharged into the pumping chamber 276.

Preferably, a separate coolant supply (not shown) is provided for the cylinder head 282 and block 280. This coolant system supplies cooling water from the propulsion passage 276 to the cylinder head 282, then cylinder block 280, and then to a discharge.

The cooling system arranged in accordance with the embodiment illustrated in FIGS. 11–13 and described above has several advantages. First, the cooling water is arranged to flow from the exhaust manifolds 296,298 along the exhaust system to a point exterior of the watercraft 220. This allows the cooling water to cool the exhaust system in the order of the hottest to the coolest portions thereof. Since water jackets extend around and along the length of the exhaust system, the exhaust system noise is dampened.

Also, since the exhaust path for the exhaust from each combustion chamber remains separate until the second water lock, back pressure problems are reduced, improving the combustion and exhaust efficiencies of the cylinder of the engine. Also, since no cooling water is introduced into the exhaust gas itself, the resistance of the flow of the exhaust gas to discharge is lessened, increasing the performance of the engine 222.

Lastly, since the water locks are arranged on the same side of the engine 222, the exhaust system may extend in straighter fashion to the rear of the watercraft 220, improving exhaust flow efficiency.

Of course, the foregoing description is that of preferred embodiments of the invention, and various changes and modifications may be made without departing from the spirit and scope of the invention, as defined by the appended claims.

What is claimed is:

1. A watercraft having a water propulsion unit powered by a four-cycle engine, said water propulsion unit comprising a propulsion passage having a water inlet and outlet and a water propulsion device driven by said engine and positioned in said passage for expelling water out said outlet, said engine including a cylinder head cooperating with a cylinder block to defined at least one combustion chamber therein, an exhaust passage leading from each combustion chamber through said cylinder head to a passage in an exhaust manifold, said exhaust manifold being formed from a body separate from said cylinder head and said cylinder block, an exhaust pipe leading from said exhaust manifold for routing exhaust gases away from said engine, said watercraft including an engine cooling system, said system including a coolant supply line extending from said propulsion passage to an exhaust manifold coolant jacket surrounding at least a portion of said exhaust manifold, a coolant flow path from said exhaust manifold coolant jacket to at least one coolant passage formed in at least one of said cylinder head and said cylinder block, and a coolant path leading from said at least one coolant passage to an exhaust pipe coolant jacket.

2. The watercraft in accordance with claim 1, wherein said exhaust manifold includes a pipe leading from an exhaust passage through said cylinder head from each combustion chamber to a merge pipe having a single outlet, and wherein said exhaust manifold cooling jacket comprises a jacket substantially surrounding said merge pipe portion of said exhaust manifold.

3. The watercraft in accordance with claim 2, wherein said outlet of said merge pipe is positioned in an exhaust chamber of an upper exhaust pipe, said upper exhaust pipe having an exhaust passage therethrough leading to a water lock, and a lower exhaust pipe having an exhaust passage therethrough leading from said water lock to a discharge.

4. The watercraft in accordance with claim 1 wherein at least a portion of the coolant circulated through the coolant path is delivered to the exhaust pipe for mixing with the exhaust gases flowing therethrough.

5. A watercraft having a water propulsion unit powered by a four-cycle engine, said water propulsion unit comprising a propulsion passage having a water inlet and outlet and a water propulsion device driven by said engine and positioned in said passage for expelling water out said outlet, said engine including a cylinder head cooperating with a cylinder block to defined at least one combustion chamber therein, an exhaust passage leading from each combustion chamber through said cylinder head to a passage in an exhaust manifold, an exhaust pipe leading from said exhaust manifold for routing exhaust gases away from said engine, a recirculating lubricating system for lubricating said engine with oil from an oil, a n oil cooler, and an engine cooling system including a coolant supply line extending from said propulsion passage to an engine coolant jacket formed in said cylinder block and said cylinder head, said engine cooling system including a coolant supply line leading to said oil cooler for cooling oil flowing therethrough before the coolant has passed through said cylinder head and cylinder block cooling jackets.

6. The watercraft in accordance with claim 5, wherein said supply is a separate, second supply line extending from said propulsion passage to said oil cooler.

7. The watercraft in accordance with claim 5, wherein a coolant outlet is provided from said oil cooler, a portion of said coolant delivered to a cooling water tell-tale port through a first line, and the remainder of said coolant delivered through a second line to said engine cooling jacket.

8. The watercraft in accordance with claim 5, wherein some of the coolant passing through the oil cooler is delivered to the engine cooling jacket.

9. A watercraft having a water propulsion unit powered by a four-cycle engine, said water propulsion unit comprising a propulsion passage having a water inlet and outlet and a water propulsion device driven by said engine and positioned in said passage for expelling water out said outlet, said engine including a cylinder head cooperating with a cylinder block to defined at least one combustion chamber therein, an exhaust passage leading from each combustion chamber through said cylinder head to a passage in an exhaust manifold, an exhaust pipe leading from said exhaust manifold for routine exhaust gases away from said engine, said watercraft including an engine cooling system, said system including a coolant supply line extending from said propulsion passage to an exhaust manifold coolant jacket surrounding at least a portion of said exhaust manifold, at least one coolant passage in said cylinder head, at least one coolant passage in said cylinder block, an exhaust pipe coolant jacket, and a coolant flow path leading from said exhaust manifold coolant jacket to said at least one coolant passage in said cylinder head and then to said at least one coolant passage in said cylinder block, and then to said exhaust pipe coolant jacket.

10. A watercraft having a water propulsion unit powered by a four-cycle engine, said water propulsion unit comprising a propulsion passage having a water inlet and outlet and a water propulsion device driven by said engine and positioned in said passage for expelling water out said outlet, said engine including a cylinder head cooperating with a cylinder block to defined at least one combustion chamber therein, an exhaust passage leading from each combustion chamber through said cylinder head to a passage in an exhaust manifold, an exhaust pipe leading from said exhaust manifold for routing exhaust gases away from said engine, said watercraft including an engine cooling system, said system including a coolant supply line extending from said propulsion passage to an exhaust manifold coolant jacket surrounding at least a portion of said exhaust manifold at least one coolant passage in said cylinder head, at least one coolant passage in said cylinder block, an exhaust pipe coolant jacket, and a coolant flow path leading from said exhaust manifold coolant jacket to said at least one coolant passage in said cylinder head and said at least one coolant passage in said cylinder block, and to said exhaust pipe coolant jacket from both said at least one passage in said cylinder head and said at least one passage in said cylinder block.

11. A watercraft having a water propulsion unit powered by a four-cycle engine, said water propulsion unit comprising a propulsion passage having a water inlet and outlet and a water propulsion device driven by said engine and positioned in said passage for expelling water out said outlet, said engine including a cylinder head cooperating with a cylinder block to defined at least one combustion chamber therein, an exhaust passage leading from each combustion chamber through said cylinder head to a passage in an exhaust manifold, an exhaust pipe leading from said exhaust manifold for routing exhaust gases away from said engine, said watercraft including an engine cooling system, said system including a coolant supply line extending from said propulsion passage to an exhaust manifold coolant jacket surrounding at least a portion of said exhaust manifold, a coolant flow path from said exhaust manifold coolant jacket to at least one coolant passage in said cylinder head or cylinder block, and a coolant path leading from said at least one coolant passage in said cylinder head or block to an exhaust pipe coolant jacket, a portion of the coolant delivered to said exhaust pipe coolant jacket being delivered to exhaust passing through said exhaust pipe, and the remainder of said coolant being delivered through a return pipe from said exhaust pipe coolant jacket to a discharge from said watercraft.

12. A watercraft having a water propulsion unit powered by a four-cycle engine, said engine having at least one combustion chamber, an exhaust system for routing exhaust gases produced in said at least one combustion chamber from said engine, and a liquid cooling system, said cooling system including a coolant inlet, and a coolant supply line leading from said inlet to a coolant jacket surrounding a substantial length of said exhaust system said exhaust system including an exhaust passage leading from each combustion chamber to a separate passage in a portion of an exhaust manifold, each passage through said exhaust manifold leading to a separate chamber of a first water lock, separate passages of an upper exhaust pipe leading from each chamber in the first water lock to a second water lock, and at least one passage through a lower exhaust pipe leading from said second water lock to a discharge.

13. The watercraft in accordance with claim 12, wherein a separate coolant jacket is provided around each portion of the exhaust manifold.

14. The watercraft in accordance with claim 12, wherein said cooling system includes at least one exhaust manifold cooling jacket, a first water lock cooling jacket, an upper exhaust pipe cooling jacket, a second water lock cooling jacket, and a lower exhaust pipe cooling jacket.

15. The watercraft in accordance with claim 14, including means for delivering coolant from said inlet to said exhaust manifold cooling jacket then said first water lock cooling jacket then said an upper exhaust pipe cooling jacket then said second water lock cooling jacket, and then said lower exhaust pipe cooling jacket.

16. The watercraft in accordance with claim 15, wherein said means for delivering comprises a pressure pump.

* * * * *